US005699430A

United States Patent [19]

Krizay et al.

[11] Patent Number: 5,699,430

[45] Date of Patent: Dec. 16, 1997

[54] METHOD AND APPARATUS FOR ELECTRONICALLY PREVENTING UNAUTHORIZED ACCESS TO EQUIPMENT

[76] Inventors: Mario John Krizay, 42 Parsons Avenue, Springvale, 3171, Victoria; Sam Lazarakis, 35 Florey Crescent, Mulgrave, 3170, Victoria, both of Australia

[21] Appl. No.: 526,996

[22] Filed: Sep. 12, 1995

[51] Int. Cl.[6] ..... H04K 1/00

[52] U.S. Cl. ..... 380/23; 380/3

[58] Field of Search ..... 380/23, 3, 49; 340/825.39

[56] References Cited

U.S. PATENT DOCUMENTS

| | | | |
|---|---|---|---|
| 3,725,939 | 4/1973 | Saltzstein | 343/225 |
| 4,688,036 | 8/1987 | Hirano et al. | 340/325.69 |
| 4,733,638 | 3/1988 | Anderson | 123/198 B |
| 4,794,268 | 12/1988 | Nakano et al. | 307/10 AT |
| 4,996,514 | 2/1991 | Sunami | 340/426 |
| 4,996,515 | 2/1991 | Schaffer et al. | 340/426 |

FOREIGN PATENT DOCUMENTS 655752 1/1995 Australia .

OTHER PUBLICATIONS

PM 1409, Filed Sep. 24, 1993, "Electronic Security Device".

PM 7814, Filed Sep. 1, 1994, "Electronic Security Device".

PM 9108, Filed Oct. 28, 1994, "Electronic Security Method".

PCT/GB84/00104, Filed Mar. 28, 1984, "Improvements Relating to a Security System".

PCT/AU92/00391, Filed Jul. 30, 1992, "Vehicle Security System".

PCT/AU92/00391, Issued Nov. 13, 1992, International Search Report.

*Primary Examiner*—David C. Cain

*Attorney, Agent, or Firm*—Marion P. Lelong

[57] ABSTRACT

An electronic security method and apparatus prevents unauthorized access to a security device, communications equipment or other equipment by generating a data coded signal between an encoding device couple with a transmitter and a decoding device coupled with a receiver; part of the coded signal is fixed but the remainder is continuously and automatically changing with reference to time and synchronization is maintained between transmitter and receiver by an identical timer chip clock in each which operates on the same oscillation frequency; specially designed computer software is used to program an identical microcontroller unit within the transmitter and the receiver.

14 Claims, 1 Drawing Sheet

METHOD AND APPARATUS FOR ELECTRONICALLY PREVENTING UNAUTHORIZED ACCESS TO EQUIPMENT

TECHNICAL FIELD

The invention relates to electronic security equipment. More specifically, the invention is directed to electronic security equipment using a transmitted data coded signal with a changing data code part for preventing unauthorized access to security devices or equipment.

BACKGROUND OF THE INVENTION

Prior data code equipment and devices used to communicate data codes between a transmitter and a receiver (whether by radio-frequency or electro-mechanical link means such as cables) contain a fixed signal code which is used during every transmission and no matter what device it is incorporated into or what method is used such as for example a radio-frequency rf remote control security system arming/disarming a vehicle, opening a garage door and so forth, it can be detected by unauthorized persons, using electronic detection/analysing/recording equipment. Retransmitting duplicated/recorded or learned code in the same manner will allow access to one's property or enable use of the learned code to intercept communications in a link, Any fixed code is no longer secure and creates problems of unauthorized access.

SUMMARY OF THE INVENTION

One object of this invention is to provide an electronic security apparatus which will solve the problem of unauthorized access to security equipment by use of learned fixed codes.

Another object is to provide an electronic security method with changing codes to prevent learning of a fixed signal code by unauthorized persons.

In accordance with the first of these objects and the principles of the present invention there is provided an electronic security apparatus for preventing unauthorized access to a security device, communications equipment or other equipment. The apparatus comprises: an encoding device coupled with a transmitter and a decoding device coupled with a receiver, a data-coded signal being generated between the transmitter and receiver, part of the coded signal is fixed and the remainder is continuously and automatically changing. A timer clock chip in the transmitter and an identical timer clock chip in the receiver maintain synchronization between the transmitter and the receiver by operating on the same oscillation frequency which is factory-adjustable during manufacture by interchanging crystals of different values. There is a microcontroller chip in the encloder of the transmitter and an identical one in the decoder of the receiver and each microcontroller chip has its own re-set mode programmed in at the time of manufacture. The transmitter is a portable hand-held unit and the receiver can be fixed in a vehicle to lock and unlock or activate and de-activate it or can be fixed in a garage to operate garage doors.

Again in accordance with these objects and principles of this invention there is provided a method for preventing unauthorized access to a security device, communications equipment or other equipment, the method comprises generating a data-coded signal between an encoder coupled with a transmitter and a decoder coupled with a receiver; fixing a part of the coded signal and continuously and automatically changing the remainder of the signal with reference to time whilst maintaining synchronization of both the transmitter and the receiver.

The method further comprises programming specially-designed software into a microcontroller chip within the encoding device and into an identical microcontroller chip within the decoding device while maintaining synchronization of the changing signal code part by operating a timer chip clock in both the transmitter and receiver, each of said clocks being identical and operating at the same internal oscillation frequency to determine the rate of change of the code. To continuously and automatically change the non-fixed part of the code, an identical timer clock chip and micro-controller chip is used in both the transmitter and the receiver. Electric power is connected to the transmitter and receiver and then re-set initialization of timer clock chips in each is carried out to synchronize the clocks of the chips in time from any random and different time mode by a reset mode.

Advantages of the invention are that the clocks of the transmitter and receiver units of each set of the apparatus are not set to real time which makes unauthorized access difficult if not impossible. Furthermore, the re-set function can only be invoked if continuous valid data is received, hence making it highly unlikely for a learned code to be used by unauthorized persons.

The novel arrangement of features which are considered to characterize the invention are set forth in particular in the appended claims.

DESCRIPTION OF THE DRAWINGS

While several objects of the invention have been noted, other objects, uses and advantages will become apparent as the nature of the invention is more fully disclosed in the description with reference to the accompanying drawings. Furthermore, various other features of the present invention will also become apparent to those skilled in the art after reading the following more detailed description.

A non-limitative example of a preferred embodiment of the electronic security method and apparatus of the invention will now be described with reference to the accompanying diagrammatic drawings in which.

DESCRIPTION OF EXAMPLE AND ILLUSTRATED EMBODIMENT

Figure 1:
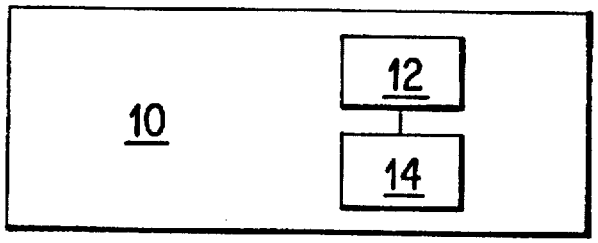
FIG. 1 is a block diagramm of an arrangement of the transmitter of the electronic security apparatus or system used in the method according to the invention.
Figure 2:
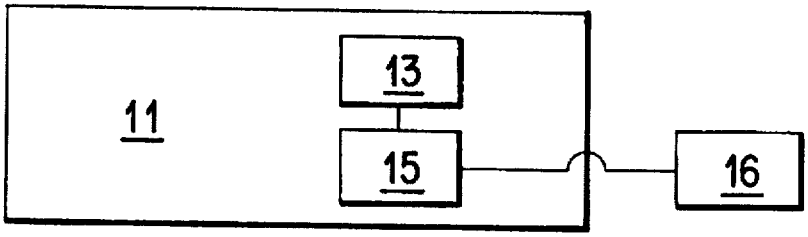
FIG. 2 is a block diagram of an arrangement of the receiver of the electronic security apparatus or system used in the method according to the invention.
Figure 3:
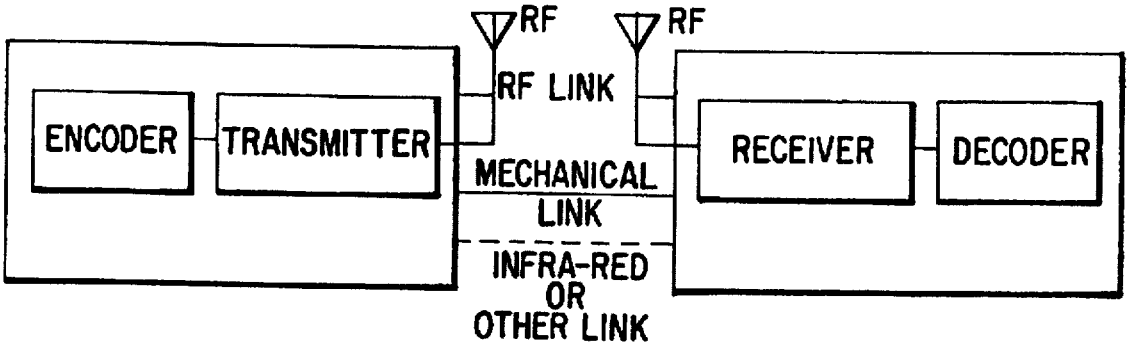
FIG. 3 is a block diagramm of apparatus incorporating a transmitter and a receiver with alternative types of operational links for use in the electronic security method according to the invention.

Reference is now made to the diagrammatic drawings in which FIGS. 1 and 2 show electronic security apparatus for preventing unauthorized access to equipment such as a car or garage by generating a coded signal between an encoder coupled with a transmitter 10 and a decoder coupled with a receiver 11 both in a set as part of a system and in this example a portable, hand-held, cordless, battery-operated, remote-control, rf radio-frequency coded-signal transmitter 10 and a rf radio-frequency, coded signal receiver 11. A timer clock chip 12 is in the transmitter 10 and an identical timer clock chip 13 is in the receiver 11; each timer chip clock operates at the same frequency. The timer clock chips 12, 13 change the transmitted code within a regular time period and maintain synchronization by operating at the same internal oscillation frequency which is factory adjustable by interchanging crystals of different values. The transmitter 10 also incorporates a microcontroller chip 14. A microcontroller chip 15 identical to that within the transmitter 10 is incorporated in the receiver 11. Thus each transmitter of any given set contains a timer clock chip plus a microcontroller chip and each receiver of the same set contains a timer clock chip and a microcontroller chip both of which are identical to those in the transmitter. A suitable timer clock chip for use in the method and apparatus of this invention is that designated DAS-16V54 of Dallas and a suitable micro-controller chip is that designated TIC-16C54 of Micro-Chip Technology.

In this example, the receiver component of the apparatus is incorporated or installed within a vehicle 16 but could be installed within other equipment such as within a garage for preventing unauthorized access by preventing opening of the garage door.

Although the apparatus of this invention has been described in the example as utilizing separate timer clock chips and microcontroller chips, it should be understood that these dual-function items could be incorporated into a single chip or there could be other chips additional to or as alternatives to those described.

OPERATION

A data-coded signal is generated by the transmitter and detected by the receiver component of the apparatus of the invention and this signal has both a fixed code part and a changing code part and the changing part of the data-coded signal is constantly and automatically changing with reference to time in a set order in both the transmitter and the receiver.

Once power is connected to the hand-held transmitter and to the receiver via an in-unit battery or other source of D.C. voltage, the timer clock chips 12, 13 are synchronized in time by a reset mode as the clocks are at a random and probably different time so reset initialization must take place. Each transmitter and receiver is manufactured and supplied with its own re-set mode which is programmed in at the time of manufacture. Once the clocks of the timer clock chips 12, 13 are synchronized, the apparatus and any system incorporating it are ready for normal use. The operator presses a switch on the hand-held transmitter 10, transmitting a part-fixed data-coded signal and a part-changing data-coded signal which is retrieved from a look up table corresponding to the time of transmission. The apparatus or system uses the timer clock chips 12, 13 to change part of the data-coded signal at pre-set time intervals. The operation of the receiver 11 is such that if the fixed part of the data-coded signal is correct, the apparatus continues to operate and compares the changing part of the coded signal which, if the clocks are aligned, the signal will be the same, depending on the time of transmission. If the changing part of the signal is correct, the receiver 11 then activates or de-activates whatever equipment it is controlling. If a wrong coded signal is detected by the receiver, it does not respond.

Various modifications of the invention may be made within the scope of the claims and it will be understood that the embodiment described above is in no way restrictive and may give rise to any desirable modification without departing from the scope of the invention.

We claim:

1. An electronic security apparatus for preventing unauthorized access to a security device or communications equipment, the apparatus comprising of an encoding device coupled with a transmitter and a decoding device coupled with a receiver, a data-coded signal being generated between the said transmitter and the said receiver, part of the coded signal being fixed while the remainder of the signal is continuously and automatically changing with reference to time, and means for maintaining synchronization between the said transmitter and the said receiver.

2. The apparatus as claimed in claim 1 wherein the means for maintaining synchronization between the transmitter and receiver is a timer clock chip in the transmitter and another timer clock chip in the receiver, both timer clock chips being identical and being adapted to operate on the same internal oscillation frequency.

3. The apparatus according to claim 1 wherein a programmable microcontroller chip is in the encoder which is within the transmitter and another microcontroller chip identical to that in the encoder is in the decoder which is within the receiver.

4. The apparatus according to claim 2 wherein the frequency of the timer clock chip of the transmitter and also that of the receiver is factory-adjustable during manufacture by interchanging crystals of different value.

5. The apparatus according to claim 1 wherein the means for maintaining synchronization between the transmitter and the receiver is a timer clock chip in the transmitter and an identical chip in the receiver, both said chips operating on the same internal oscillation frequency and wherein a programmable microcontroller chip is in the encoder in the transmitter and an identical programmable microcontroller chip is in the decoder in the receiver, and wherein each timer clock chip and each microcontroller chip is incorporated into a single chip.

6. The apparatus according to claim 3 wherein each microcontroller chip has its own re-set mode programmed in at the time of manufacture.

7. The apparatus according to claim 1 including a timer clock chip in the transmitter and an identical timer clock chip in the receiver for maintaining synchronization of data-coded signals between the transmitter and the receiver, identical programmable microcontroller chips being in the encoder in the transmitter and in the decoder in the receiver respectively and wherein the said apparatus is adapted to be incorporated into a system which additionally comprises a vehicle or any other equipment to be abled or disabled.

8. The apparatus according to claim 7 wherein the transmitter is portable and hand held and operates on radio-frequency signals and the receiver is fixed within a vehicle and operates on the same radio-frequency signals as the signals of the transmitter.

9. The apparatus according to claim 7 wherein the transmitter is portable and is hand-held and operates on radio-frequency signals and the receiver is fixed within a garage and operates on the same radio-frequency signals as the signals of the transmitter.

10. A method for preventing unauthorized access to a security device, communications equipment or other equipment, the method comprising generating a data coded signal between an encoder device coupled with a transmitter and a decoding device coupled with a receiver, fixing part of the coded signal and continuously and automatically changing the remainder of the signal with reference to time while maintaining synchronization of the signals of both transmitter and receiver.

11. The method according to claim 10 which further comprises programming specially-designed software into a microcontroller chip contained within the encoder device and into a microcontroller chip contained within the decoding device while maintaining synchronization of the changing signal code by operating a timer chip clock in both the transmitter and the receiver, each of said clocks being identical and operating at the same internal oscillation frequency which determines rate of change of the code.

12. The method according to claim 11 which further comprises using identical timer clock chips and identical microcontroller chips in both encoding and decoding devices to continuously and automatically change the non-fixed part of the coded signal while maintaining synchronization between the encoding device and thus the transmitter and the decoding device and thus the receiver.

13. The method according to claim 10 which further comprises programming specially-designed software into a microcontroller chip contained within the encoder device and into a microcontroller chip contained within the decoding device while maintaining synchronization of the changing signal code by operating a timer chip clock in both the transmitter and the receiver, each of the said clocks being identical and operating at the same internal oscillation frequency which determines the rate of change of the code the method further comprising using identical timer clock chips and identical microcontroller chips in both encoding and decoding devices to continuously and automatically change the non-fixed part of the coded signal while maintaining synchronization between the encoding device and thus the transmitter and the decoding device and thus the receiver, and wherein after electric power is connected to the transmitter and to the receiver via an in unit battery or other source of direct current voltage, reset initialization is effected of the timer chip clocks of both the transmitter and the receiver respectively to synchronize the chips in time from any random and different time mode by a reset mode.

14. A method of preventing unauthorized access to a security device, communications equipment or other equipment the method comprising generating a coded signal between an encoder device coupled with a transmitter and a decoding device coupled with a receiver, fixing part of the coded signal and continously and automatically changing the remainder of the signal with reference to time whilst maintaining synchronization of both the transmitter and the receiver by timer clock chips of the same internal oscillation frequency in the encoder and transmitter and in the decoder and receiver and also by programmable identical microcontroller chips in the encoder and transmitter and the decoder and receiver wherein when an operator presses a switch on a hand-held portable transmitter transmitting a data-coded signal wherein part of the signal is fixed and the remainder is changing, the signal is retrieved from a look-up table corresponding to signal transmission time, the timer clock chips change part of the coded signal at pre-set time intervals whereby if the fixed part of the data-coded signal from the transmitter is detected and identified by the receiver as being correct, the receiver compares the changing part of the coded signal which if the clocks are aligned will be identical on both transmitter and receiver dependent on transmission time and whereby if the changing part of the signal is correct the receiver then activates or de-activates whatever equipment it is controlling and if a wrong signal is detected by the receiver it does not respond.

* * * * *